US011401875B2

(12) United States Patent
Kurtz et al.

(10) Patent No.: US 11,401,875 B2
(45) Date of Patent: Aug. 2, 2022

(54) SYSTEM AND METHOD FOR WARMING AN EMISSIONS DEVICE OF AN ENGINE EXHAUST SYSTEM

(71) Applicant: Ford Global Technologies, LLC, Dearborn, MI (US)

(72) Inventors: Eric Matthew Kurtz, Dearborn, MI (US); Jason Brian Martz, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 36 days.

(21) Appl. No.: 16/798,163

(22) Filed: Feb. 21, 2020

(65) Prior Publication Data

US 2021/0262407 A1 Aug. 26, 2021

(51) Int. Cl.

| | |
|---|---|
| ***F02D 41/02*** | (2006.01) |
| ***F02D 13/06*** | (2006.01) |
| ***F02D 9/08*** | (2006.01) |
| ***F02D 41/38*** | (2006.01) |
| ***F01L 13/00*** | (2006.01) |
| ***F02D 13/02*** | (2006.01) |
| ***F01N 3/20*** | (2006.01) |
| ***F02D 41/00*** | (2006.01) |

(52) U.S. Cl.

CPC ..... *F02D 41/0245* (2013.01); *F01L 13/0005* (2013.01); *F01N 3/2006* (2013.01); *F02D 9/08* (2013.01); *F02D 13/0226* (2013.01); *F02D 13/06* (2013.01); *F02D 41/0002* (2013.01); *F02D 41/38* (2013.01); *F01L 2013/001* (2013.01)

(58) Field of Classification Search

CPC ..... F02D 41/0245; F02D 41/0002; F02D 41/0087; F02D 13/0226; F02D 13/06; F01L 13/0005; F01L 2013/001; F01N 3/2006

USPC ..... 60/320

See application file for complete search history.

(56) References Cited

U.S. PATENT DOCUMENTS 6,805,079 B1 * 10/2004 Brehob ..... F01L 9/20 123/90.11

2014/0261309 A1 * 9/2014 Chen ..... F02D 41/0082 123/320

FOREIGN PATENT DOCUMENTS

WO 2016036936 A1 3/2016

OTHER PUBLICATIONS

Gosala, D. et al., "Fuel-efficient thermal management in diesel engines via valvetrain-enabled cylinder ventilation strategies," International Journal of Engine Research, Aug. 2, 2019, 13 pages.

* cited by examiner

*Primary Examiner* — Mahmoud Gimie

(74) *Attorney, Agent, or Firm* — Vincent Mastrogiacomo; McCoy Russell LLP

(57) ABSTRACT

Methods and systems for increasing exhaust gas temperatures of an engine are described. In one example, engine exhaust gas temperatures may be increased via deactivating cylinders and flowing exhaust gases through deactivated cylinder. Engine pumping losses may be reduced via the exhaust gases that flow through the deactivated cylinder so as to reduce engine fuel consumption while heating an exhaust gas after treatment device.

19 Claims, 6 Drawing Sheets

SYSTEM AND METHOD FOR WARMING AN EMISSIONS DEVICE OF AN ENGINE EXHAUST SYSTEM

BACKGROUND/SUMMARY

A diesel engine may include an exhaust after treatment device for processing exhaust gases from the engine. The after treatment device may operate with a desired efficiency when a temperature of the after treatment device is greater than a threshold temperature (e.g., a catalyst light off temperature). The after treatment device may be heated via exhaust gases; however, at lighter engine loads and lower engine speeds, exhaust temperatures may be lower than desired due at least in part to lean combustion within the diesel engine. It may be desirable to increase exhaust gas temperature at low engine loads, but it may be difficult to achieve higher exhaust gas temperatures without significantly increasing engine fuel consumption. Therefore, it may be desirable to provide a way of warming an exhaust after treatment device in a way that less significantly increases engine fuel consumption.

The inventors herein have recognized the above-mentioned disadvantages and have developed an engine operating method, comprising: deactivating a cylinder and holding an intake poppet valve of the cylinder open for an entire duration of a cycle of an engine that includes the cylinder; and operating an exhaust valve of the cylinder during the cycle.

By deactivating one or more cylinders and holding intake valves of the one or more cylinders open for an entire duration of an engine cycle, it may be possible to increase engine exhaust gas temperature while consuming less fuel. In particular, exhaust gases may flow through deactivated cylinders and into activated cylinders to reduce engine pumping work and decrease engine fuel consumption. In some examples, an opening amount of a central throttle may be reduced to facilitate exhaust gas flow through the deactivated cylinders.

The present description may provide several advantages. In particular, the approach may reduce engine fuel consumption while increasing engine exhaust temperatures. In addition, the approach may reduce engine emissions via increasing a temperature of an after treatment device. Further, the approach may also be implemented with a central throttle and port throttles to further reduce engine pumping work and increase engine fuel economy.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 3:
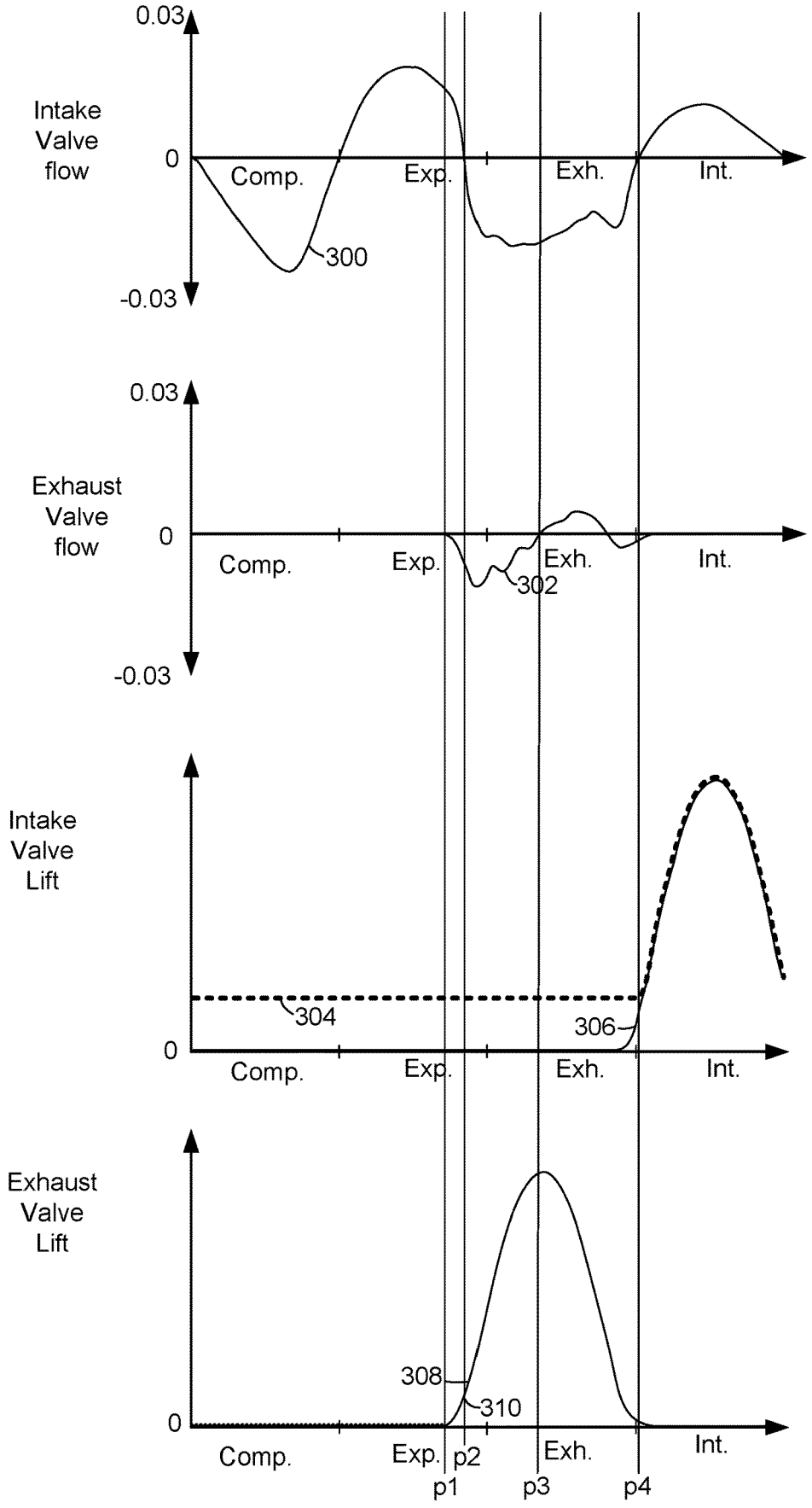
FIGS. 3 and 4 show example prophetic engine operating sequences according to the present system and methods.
Figure 4:
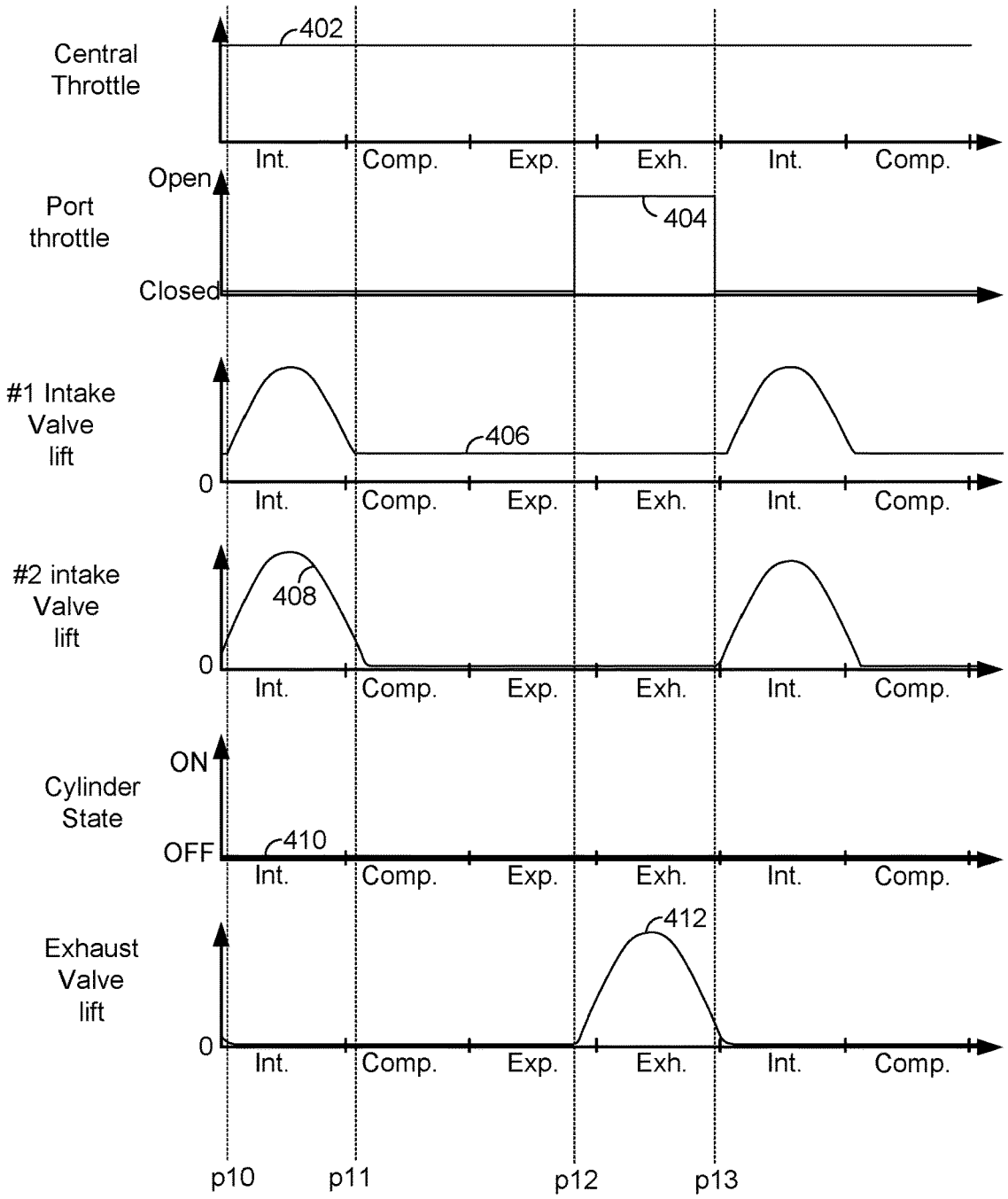

The present description is related to operating a diesel engine that includes an exhaust gas after treatment device. The engine may be of the type shown in FIGS. 1-2B. The engine may be operated as shown in the sequences of FIGS. 3 and 4. The engine of FIGS. 1-2B may be operated according to the method of FIGS. 5 and 6 to increase exhaust gas temperatures and reduce engine fuel consumption.

Figure 1:
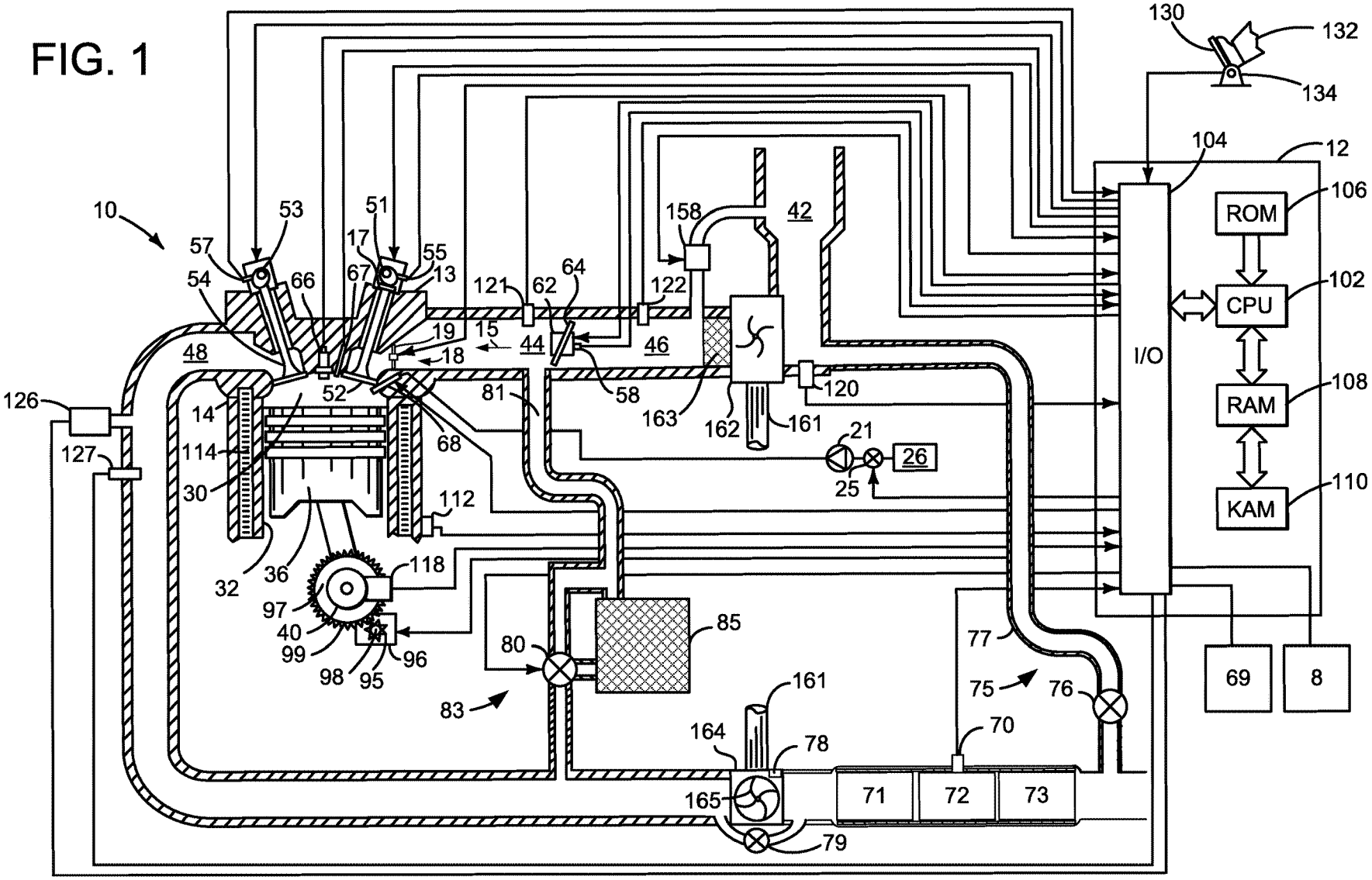
FIG. 1 shows a schematic depiction of an example engine.

Referring to FIG. 1, internal combustion engine 10, comprising a plurality of cylinders, one cylinder of which is shown in FIG. 1, is controlled by electronic engine controller 12. The controller 12 receives signals from the various sensors of FIG. 1 and employs the various actuators of FIG. 1 to adjust engine operation based on the received signals and instructions stored on a memory of the controller.

Engine 10 includes combustion chamber 30 and cylinder walls 32 with piston 36 positioned therein and connected to crankshaft 40. Cylinder head 13 is fastened to engine block 14. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Although in other examples, the engine may operate valves via a single camshaft or pushrods. The position of intake cam 51 may be determined by intake cam sensor 55. The position of exhaust cam 53 may be determined by exhaust cam sensor 57. Intake valve 52 may be held open during an entire cycle (e.g., four strokes) of engine 10 via decompression actuator 17. In one example, decompression actuator operates via providing negative lash. Engine 10 may optionally include a port throttle 19, which is positioned in intake port 18 downstream of central throttle 62 according to a direction of air flow into engine 10 as indicate by arrow 15. Port throttle 19 may selectively control flow of gases into and out of cylinder 30.

Fuel injector 68 is shown positioned in cylinder head 13 to inject fuel directly into combustion chamber 30, which is known to those skilled in the art as direct injection. Fuel is delivered to fuel injector 68 by a fuel system including a fuel tank 26, fuel pump 21, fuel pump control valve 25, and fuel rail (not shown). Fuel pressure delivered by the fuel system may be adjusted by varying a position valve regulating flow to a fuel pump (not shown). In addition, a metering valve may be located in or near the fuel rail for closed loop fuel control. A pump metering valve may also regulate fuel flow to the fuel pump, thereby reducing fuel pumped to a high pressure fuel pump.

Intake manifold 44 is shown communicating with optional central electronic throttle 62 which adjusts a position of throttle plate 64 to control air flow from intake boost chamber 46. Compressor 162 draws air from air intake 42 to supply boost chamber 46. Exhaust gases spin turbine 164 which is coupled to compressor 162 via shaft 161. A position of turbine vanes 165 may be adjusted to increase or decrease speed and efficiency of turbine 164. In particular, compressor speed may be adjusted via adjusting a position of variable vane control 78 or compressor bypass valve 158. In alternative examples, a waste gate 79 may replace or be used in addition to variable vane control 78. Variable vane control 78 adjusts a position of variable geometry turbine vanes 165. Exhaust gases can pass through turbine 164 supplying little energy to rotate turbine 164 when vanes 165 are in an open position. Exhaust gases can pass through turbine 164 and impart increased force on turbine 164 when vanes 165 are in a closed position. Alternatively, wastegate 79 or a bypass valve may allow exhaust gases to flow around turbine 164 so as to reduce the amount of energy supplied to the turbine. Compressor bypass valve 158 allows compressed air at the outlet of compressor 162 to be returned to the input of compressor 162. In this way, the efficiency of compressor 162 may be reduced so as to affect the flow of compressor 162 and reduce the possibility of compressor surge.

Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99 such that starter 96 may rotate crankshaft 40 during engine cranking. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. An engine start may be requested via human/machine interface (e.g., key switch, pushbutton, remote radio frequency emitting device, etc.) 69 or in response to vehicle operating conditions (e.g., brake pedal position, accelerator pedal position, battery SOC, etc.). Battery 8 may supply electrical power to starter 96 and controller 12 may monitor battery state of charge.

Combustion is initiated in the combustion chamber 30 when fuel automatically ignites when combustion chamber temperatures reach the auto-ignition temperature of the fuel when the piston 36 is near top-dead-center compression stroke. In some examples, a universal Exhaust Gas Oxygen (UEGO) sensor 126 may be coupled to exhaust manifold 48 upstream of exhaust gas after treatment device 71. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures a glow plug 66 may convert electrical energy into thermal energy so as to create a hot spot next to one of the fuel spray cones of an injector in the combustion chamber 30. By creating the hot spot in the combustion chamber next to the fuel spray 30, it may be easier to ignite the fuel spray plume in the cylinder, releasing heat that propagates throughout the cylinder, raising the temperature in the combustion chamber, and improving combustion. Cylinder pressure may be measured via pressure sensor 67.

Exhaust gas after treatment device 71 may include an oxidation catalyst and it may be followed by a SCR 72 and a diesel particulate filter (DPF) 73, in one example. In another example, SCR 72 may be positioned upstream of oxidation catalyst. NOx sensor 70 provides an indication of NOx in engine exhaust gases.

Exhaust gas recirculation (EGR) may be provided to the engine via high pressure EGR system 83. High pressure EGR system 83 includes valve 80, EGR passage 81, and EGR cooler 85. EGR valve 80 is a valve that closes or allows exhaust gas to flow from upstream of exhaust gas after treatment device 71 to a location in the engine air intake system downstream of compressor 162. EGR may bypass EGR cooler 85, or alternatively, EGR may be cooled via passing through EGR cooler 85. EGR may also be provided via low pressure EGR system 75. Low pressure EGR system 75 includes EGR passage 77 and EGR valve 76. Low pressure EGR may flow from downstream of emissions device 71 to a location upstream of compressor 162. A charge air cooler 163 may be provided downstream of compressor 162.

Controller 12 is shown in FIG. 1 as a conventional microcomputer including: microprocessor unit 102, input/output ports 104, read-only memory (e.g., non-transitory memory) 106, random access memory 108, keep alive memory 110, and a conventional data bus.

Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by human foot 132; a measurement of engine manifold pressure (MAP) from pressure sensor 121 coupled to intake manifold 44; boost pressure from pressure sensor 122 exhaust gas oxygen concentration from oxygen sensor 126; exhaust manifold pressure from pressure sensor 127; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle.

In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

Figure 2A:
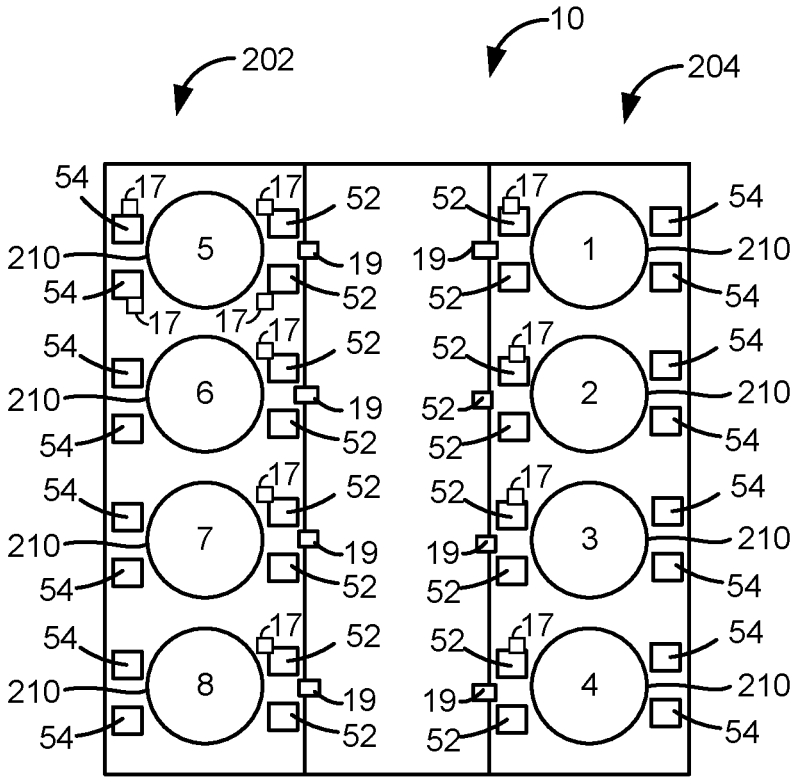
FIGS. 2A and 2B show example engine cylinder configurations.

Referring now to FIG. 2A, an example multi-cylinder engine that includes two cylinder banks is shown. The engine includes cylinders and associated components as shown in FIG. 1. Engine 10 includes eight cylinders 210. Each of the eight cylinders is numbered and the numbers of the cylinders are included within the cylinders. A port throttle 19 is included with each cylinder; however, fewer port throttles may be provided in some examples. Port throttle 19 selectively controls flow of gases into and out of cylinders 210 via cylinder intake ports 18 shown in FIG. 1. One port throttle may restrict flow into or out of the cylinder's two intake ports. Alternatively, a port throttle may be provided for each intake port of a cylinder. One or more of cylinders 1-8 may be selectively deactivated via ceasing to flow fuel to the cylinders being deactivated. For example, cylinders 2, 3, 5, and 8 (e.g., a fixed pattern of deactivated cylinders) may be deactivated during an engine cycle (e.g., two revolutions for a four stroke engine) and may be deactivated for a plurality of engine cycles while engine speed and load are constant or very slightly. During a different engine cycle, a second fixed pattern of cylinders 1, 4, 6, and 7 may be deactivated. Further, other patterns of cylinders may be selectively deactivated based on vehicle operating conditions. For example, cylinders of bank 202 may be deactivated while cylinders of bank 204 remain activated (e.g., receiving and combusting fuel), or vice-versa. Additionally, engine cylinders may be deactivated such that a fixed pattern of cylinders is not deactivated over a plurality of engine cycles. Rather, cylinders that are deactivated may change from one engine cycle to the next engine cycle.

Each cylinder includes two intake valves 52 and two exhaust valves 54. However, in other examples, each engine cylinder may include only one intake valve and only one exhaust valve. Each cylinder also includes a decompression actuator 17 that selectively holds one intake valve 52 of a cylinder open less than (e.g., 1 millimeter) a full lift height of the intake valve (e.g., 8 millimeters) for an entire cycle of an engine. Further, in some examples, the decompression actuator 17 may hold the intake valve open less than a squish height of a cylinder plus a valve recess amount in the cylinder head plus a depth of valve pockets in a piston. In some examples, each cylinder may include decompression actuators 17 for each intake valve and each exhaust valve as shown for cylinder number 5. In this example, engine 10 includes a first cylinder bank 204, which includes four cylinders 1, 2, 3, and 4. Engine 10 also includes a second cylinder bank 202, which includes four cylinders 5, 6, 7, and 8.

Figure 2B:
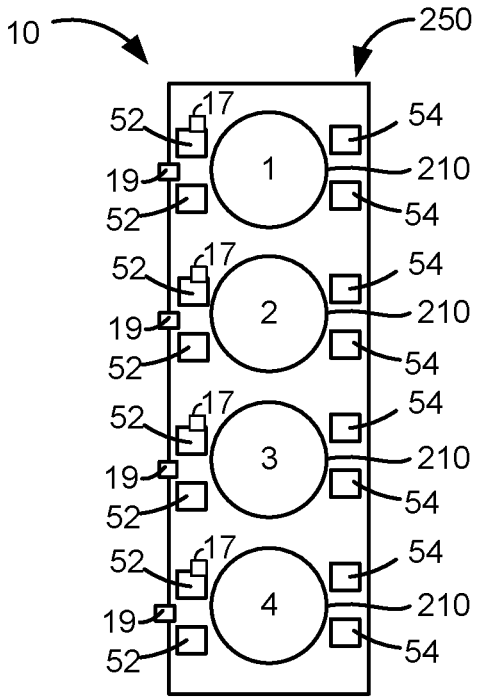

Referring now to FIG. 2B, an example multi-cylinder engine that includes one cylinder banks is shown. The engine includes cylinders and associated components as shown in FIG. 1. Engine 10 includes four cylinders 210. Each of the four cylinders is numbered and the numbers of the cylinders are included within the cylinders. A port throttle 17 is included with each cylinder; however, fewer port throttles may be provided in some examples. Port throttle 17 selectively controls flow of gases into and out of cylinders 210 via cylinder intake ports 18 shown in FIG. 1. Cylinders 1-4 may be selectively deactivated (e.g., not receiving fuel and not combusting fuel during a cycle of the engine) to improve engine fuel economy when less than the engine's full torque capacity is requested. For example, cylinders 2 and 3 (e.g., a fixed pattern of deactivated cylinders) may be deactivated during a plurality of engine cycles (e.g., two revolutions for a four stroke engine). During a different engine cycle, a second fixed pattern cylinders 1 and 4 may be deactivated over a plurality of engine cycles. Further, other patterns of cylinders may be selectively deactivated based on vehicle operating conditions. Additionally, engine cylinders may be deactivated such that a fixed pattern of cylinders is not deactivated over a plurality of engine cycles. Rather, cylinders that are deactivated may change from one engine cycle to the next engine cycle. In this way, the deactivated engine cylinders may rotate or change from one engine cycle to the next engine cycle.

Thus, the system of FIGS. 1-2B may provide for an engine system, comprising: a diesel engine including a cylinder included in a first group of cylinders, a second group of cylinders, a central throttle, and an exhaust after treatment device, the cylinder including at an intake poppet valve and a decompression actuator to lift the intake poppet valve; a controller including executable instructions stored in non-transitory memory that cause the controller to deactivate the cylinder and other cylinders included in a first group of cylinders while operating cylinders in the second group of cylinders in response to a request to heat the engine exhaust after treatment system, and additional instructions to hold the intake poppet valve open during an entire cycle of the diesel engine in response to the request to heat the engine exhaust gas after treatment system. The engine system further comprising: a central throttle, a port throttle for the cylinder, and a port throttle for each of the other cylinders included in the first group of cylinders.

In some examples, the engine system further comprises additional instructions that cause the controller to open the port throttle for the cylinder during at least a portion of an exhaust stroke of the cylinder and to close the port throttle during at least a portion of the expansion stroke. The engine system further comprises additional instructions that cause the controller to fully open the central throttle while the request to heat the engine exhaust after treatment system is asserted. The engine system includes where the intake poppet valve is held open via the decompression actuator. The engine system further comprises additional instructions increase fuel flow to cylinders in the second group of cylinders in response to the request to heat the engine after treatment system.

Referring now to FIG. 3, an engine operating sequence is shown. The sequence of FIG. 3 is for a cylinder that has been deactivated (e.g., fuel flow to the cylinder has ceased) while one or more other engine cylinders are active and causing the engine to rotate (not shown). In addition, the engine's central throttle may be partially closed. The engine in this example does not include port throttles.

Figure 5:
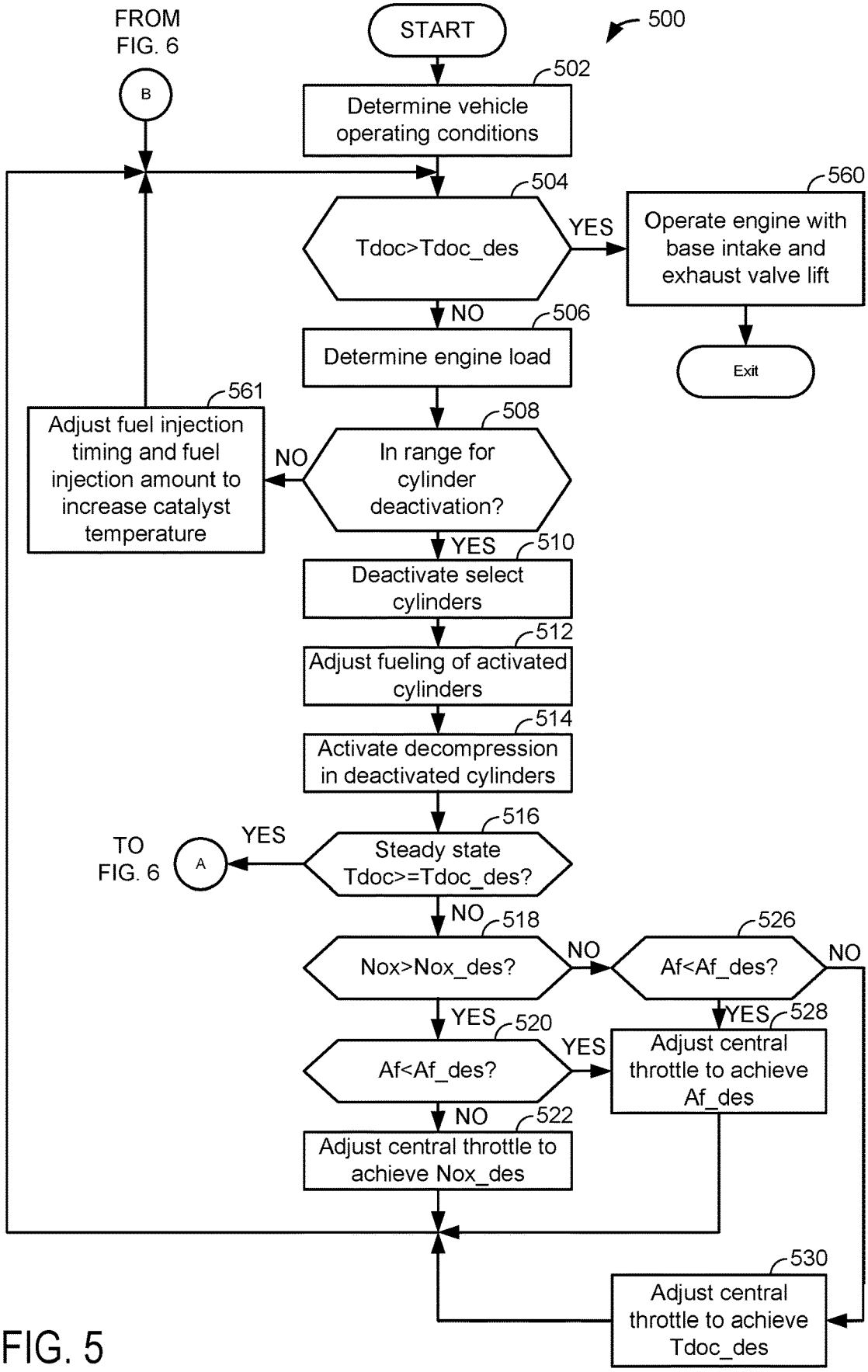
FIGS. 5 and 6 show an example method for operating an engine of the type shown in FIG. 1.
Figure 6:
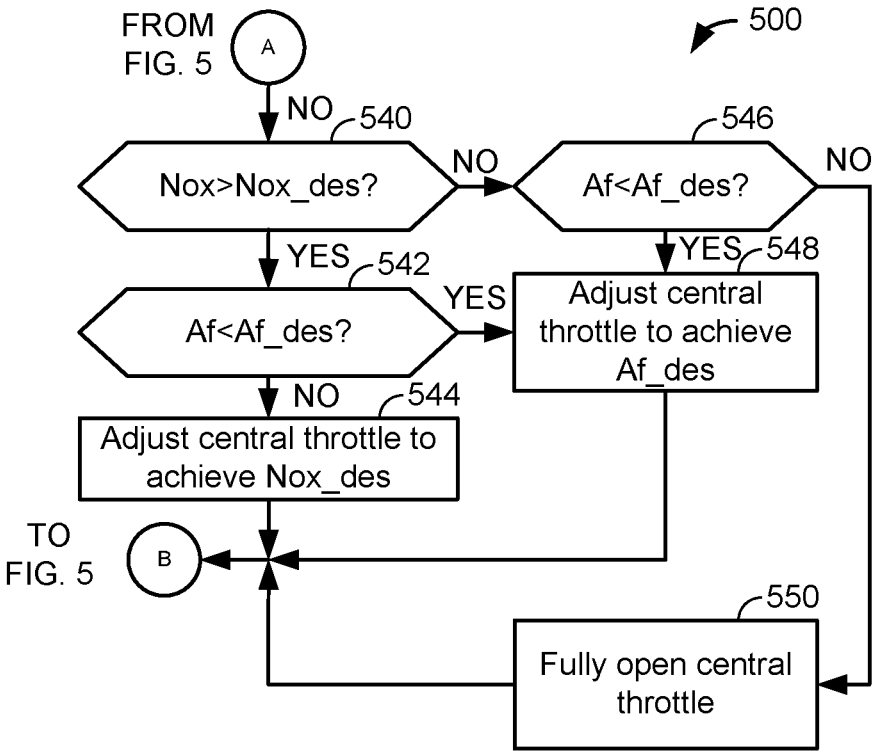

The sequence of FIG. 3 may be provided via the system of FIGS. 1-2B in cooperation with the method of FIGS. 5 and 6. The plots of FIG. 3 are time aligned and occur at a same time. Vertical lines at engine positions p1-p4 represent times of interest during the sequence. A cylinder compression stroke is indicated by the "Comp." abbreviation. A cylinder expansion stroke is indicated by the "Exp." abbreviation. A cylinder exhaust stroke is indicated by the "Exh." abbreviation. A cylinder intake stroke is indicated by the "Int." abbreviation. The engine system described herein may operate and include non-transitory instructions to operate at all the conditions included in the description of FIG. 3.

The first plot from the top of FIG. 3 represents gas flow rate across a first intake valve of a cylinder of the engine versus engine position. Trace 300 represents the flow rate across the first intake valve of a cylinder and negative flows indicate flows into the engine intake manifold. Positive flows indicate flow into the cylinder. The vertical axis represents the flow rate across the first intake valve (e.g., 52 of FIG. 1) and flow rate is zero at the level of the horizontal axis. The horizontal axis represents engine position, and engine position is marked to indicate a stroke that the cylinder of the engine is on. For example, at position p1, the cylinder is on its exhaust stroke. The vertical lines along the horizontal axis represent top-dead-center and bottom-dead-center locations for the illustrated cylinder strokes indicated along the horizontal axis. The engine rotates from the left side of the figure to the right side of the figure.

The second plot from the top of FIG. 3 represents gas flow rate across a first exhaust valve of the cylinder of the engine versus engine position. Trace 302 represents the flow rate across the first exhaust valve of a cylinder and negative flows indicate flows into the cylinder. Positive flows indicate flow into the exhaust manifold. The vertical axis represents the flow rate across the first exhaust valve (e.g., 54 of FIG. 1) and flow is zero at the level of the horizontal axis. The horizontal axis represents engine position, and engine position is marked to indicate a stroke that the cylinder of the engine is on. The vertical lines along the horizontal axis represent top-dead-center and bottom-dead-center locations for the illustrated cylinder strokes indicated along the horizontal axis.

The third plot from the top of FIG. 3 represents lift amount of intake valves (e.g., 52 of FIG. 1) versus engine position. Trace 304 represents the lift of a first intake valve of a cylinder and trace 306 represents lift of a second intake valve of the cylinder. The lift amount is zero at the level of the horizontal axis and the lift amount increases in the direction of the vertical axis arrow. The lift amount is a distance of the intake valve from the intake valve seat. The horizontal axis represents engine position, and engine position is marked to indicate a stroke that the cylinder of the engine is on. The vertical lines along the horizontal axis represent top-dead-center and bottom-dead-center locations for the illustrated cylinder strokes indicated along the horizontal axis.

The fourth plot from the top of FIG. 3 represents lift amount of exhaust valves (e.g., 54 of FIG. 1) versus engine position. Trace 308 represents the lift of a first exhaust valve of a cylinder and trace 310 represents lift of a second exhaust valve of the cylinder. The lift amount is zero at the level of the horizontal axis and the lift amount increases in the direction of the vertical axis arrow. The lift amount is a distance of the exhaust valve from the exhaust valve seat. The horizontal axis represents engine position, and engine position is marked to indicate a stroke that the cylinder of the engine is on. The vertical lines along the horizontal axis represent top-dead-center and bottom-dead-center locations for the illustrated cylinder strokes indicated along the horizontal axis.

The sequence begins on the left side of the figure where the cylinder is presently on its compression stroke and deactivated. The first intake valve of the cylinder is partially open with a non-zero lift (e.g., trace 304) generated via activating the decompression actuator of the first intake valve (not shown). The second intake valve is fully closed and its lift is zero. However, in other examples, the second intake valve may follow the same trajectory as the first intake valve during an entire engine cycle. Thus, the first and second intake valves may be held partially open during the entire engine cycle and they may fully open during the cylinder's intake stroke. The first exhaust valve of the cylinder is fully closed with zero lift (e.g., trace 308). The second exhaust valve lift is fully closed and its lift is zero. The flow across the intake valve is negative indicating that flow is from out of the cylinder and into the intake manifold during the compression stroke. Flow out of the cylinder takes place due to the first intake valve being partially open and due to the volume of the cylinder decreasing as the cylinder rotates through its compression stroke. Flow across the exhaust valve is zero since the exhaust valve is fully closed.

As the engine rotates, it passes from the cylinder's intake stroke into the cylinder's expansion stroke. The first intake valve remains partially open due to the decompression actuator of the first intake valve being activated. The second intake valve remains closed and the two exhaust valves remain closed. The flow across the first intake valve switches from negative to positive to indicate flow from the engine intake manifold into the cylinder. Flow across the exhaust valves is zero early in the expansion stroke.

At engine position p1, the two exhaust valves begin to open and flow is present across the first exhaust valve. The flow across the first exhaust valve is negative to indicate that flow is from the exhaust manifold and into the cylinder. The flow across the first intake valve remains positive as the cylinder continues toward bottom-dead-center expansion stroke. Thus, flow across the first intake valve is from the intake manifold and into the cylinder. The second intake valve remains fully closed.

At engine position p2 during the cylinder's exhaust stroke, the exhaust valves are open and the first intake valve is partially open. The second intake valve is fully closed. The flow across the first intake valve changes to negative to indicate that flow across the first intake valve is from the cylinder to the intake manifold. The flow across the first exhaust valve remains negative so that flow is from the exhaust manifold to the engine cylinder and from the engine cylinder into the intake manifold.

Between engine position p2 and engine position p3, the exhaust valves remain open and the first intake valve remains partially open. The second intake valve remains fully closed. The engine rotates from the cylinder's expansion stroke and into the cylinder's exhaust stroke. The flow across the first exhaust valve remains negative and the flow across the first intake valve remains negative to indicate that flow is from the exhaust manifold into the intake manifold. The flow in this crankshaft region is exhaust gas flow so that active cylinders are fed exhaust via the deactivated cylinder.

At engine position p3, the flow across the first engine exhaust valve changes from being negative flow to being positive flow. The flow across the first intake valve remains negative so that the cylinder is pushing exhaust gas from the cylinder into both the intake manifold and the exhaust manifold. The first intake valve remains open and the second intake valve remains closed. The exhaust valve lift is near a maximum level.

Between engine position p3 and engine position p4, the first intake valve remains open and the second intake valve begins to open near engine position p4. The exhaust valves lift amounts decrease such that the first and second exhaust valves are nearly closed at engine position p4. The flow across the first intake valve remains negative, which indicates flow is from the cylinder and into the engine intake manifold. The flow across the first exhaust valve is positive near engine position p3, and then it changes to negative just before engine position p4 is reached. Shortly before engine position p4, the cylinder enters its intake stroke.

At engine position p4, the cylinder the first and second exhaust valves are nearly closed. The first intake valve remains open and the second intake has opened a small amount. The flow across the first intake valve reverses from negative to positive to indicate that flow changes from going from the cylinder to the intake manifold to going from the intake manifold to the cylinder. The flow across the first exhaust valve is approaching zero as the exhaust valves are about to close. Shortly after position p4, the first intake poppet valve begins to follow the second intake poppet valve lift trajectory as indicted by trace 306. In this example, the second intake poppet valve lift trajectory is a baseline lift trajectory that opens the second intake poppet valve during the intake stroke of the cylinder. In other examples, the first and second poppet valves may be held open a constant amount via the decompression valve actuator, but only during an intake stroke of the cylinder, the first and second intake poppet valves may follow a baseline lift trajectory, where the baseline lift trajectory is a poppet valve lift trajectory when the cylinder is activated and combusting fuel during a cycle of the engine. By allowing the first and second intake poppet valves to follow a baseline valve lift trajectory during at least a portion of the intake stroke of the cylinder that includes the first and second intake poppet valves, engine pumping work may be reduced, thereby reducing engine fuel consumption.

It may be observed that flow rate from the exhaust manifold to the cylinder is greater than flow from the intake manifold to the cylinder during the interval between engine position p1 to just after engine position p4. Further, the flow out of the cylinder via the intake valve is greater than the flow into the cylinder via the exhaust valve. Thus, the net flow is out of the cylinder and into the intake manifold during the exhaust stroke of the cylinder. This may be verified via the area under the exhaust flow curve 302 during the exhaust stroke, which is negative. Accordingly, the net flow though the cylinder is negative, where flow from the intake manifold to the cylinder is positive and where flow from the cylinder to the intake manifold is negative.

In this way, flow may be directed from the exhaust manifold to the intake manifold so that active cylinders may receive higher concentrations of EGR to reduce engine pumping losses and improve engine fuel economy. Further, the cylinder charge of activated cylinders may be increased to generate the requested amount of torque as compared to if the engine were operating with all of its cylinders being activated. This may increase engine exhaust temperatures so that an exhaust gas after treatment device may reach a threshold temperature sooner.

It should be noted that the central throttle 62 is an important control actuator for internal EGR (e.g., exhaust gas flowing through the cylinder). Closing the central throttle 62 and reducing intake manifold pressure may increase the pressure difference between the intake manifold and the exhaust manifold. Doing so increases the cumulative mass flowing from the exhaust to intake manifold via the deactivated cylinders, increasing the exhaust mass flow rates (EGR) to the active cylinders. Additionally, the intake port throttles 19 may achieve the same effect on EGR flow, without reducing the charge density/air mass flow rates of the active cylinders. This should allow this cylinder deactivation method to work at higher engine loads compared to throttling all cylinders with the central throttle.

Referring now to FIG. 4, an engine operating sequence is shown. The sequence of FIG. 4 is for a cylinder that has been deactivated (e.g., fuel flow to the cylinder has ceased) while one or more other engine cylinders are active and causing the engine to rotate (not shown). In addition, the engine's central throttle is fully opened or it is adjusted to a position that provides a desired amount of EGR to active cylinders. The engine in this example includes port throttles.

The sequence of FIG. 4 may be provided via the system of FIGS. 1-2B in cooperation with the method of FIGS. 5 and 6. The plots of FIG. 4 are time aligned and occur at a same time. Vertical lines at engine positions p10-p13 represent times of interest during the sequence. A cylinder compression stroke is indicated by the "Comp." abbreviation. A cylinder expansion stroke is indicated by the "Exp." abbreviation. A cylinder exhaust stroke is indicated by the "Exh." abbreviation. A cylinder intake stroke is indicated by the "Int." abbreviation. The engine system described herein may operate and include non-transitory instructions to operate at all the conditions included in the description of FIG. 4.

The first plot from the top of FIG. 4 represents an opening amount of a central throttle. Trace 402 represents opening amount of the central throttle. The vertical axis represents the opening amount of the central throttle. The central throttle is fully closed when trace 402 is at the level of the horizontal axis. The central throttle is fully open when trace 402 is near the vertical axis arrow. The horizontal axis represents engine position, and engine position is marked to indicate a stroke that the cylinder of the engine is on. For example, at position p10, the cylinder is on its intake stroke. The vertical lines along the horizontal axis represent top-dead-center and bottom-dead-center locations for the illustrated cylinder strokes indicated along the horizontal axis. The engine rotates from the left side of the figure to the right side of the figure.

The second plot from the top of FIG. 4 represents an opening amount of a port throttle that is in an intake port of the cylinder. The port throttle may restrict flow into and output of both intake ports. However, in some examples, the positions of two port throttles is indicated by trace 404 and the two port throttles may control flow into and out of the cylinder's intake ports. Trace 404 represents opening amount of the port throttle. The vertical axis represents the opening amount of the port throttle. The port throttle is fully closed when trace 404 is at the level of the horizontal axis. The port throttle is fully open when trace 404 is near the vertical axis arrow. The horizontal axis represents engine position, and engine position is marked to indicate a stroke that the cylinder of the engine is on. A small separation between the horizontal axis and trace 404 is shown to increase the visibility of trace 404 even though the port throttle is fully closed when trace 404 is near the horizontal axis.

The third plot from the top of FIG. 4 represents lift of a first intake valve of the cylinder versus engine position. Trace 406 represents lift of a first intake valve of a cylinder. The lift amount is zero at the level of the horizontal axis and the lift amount increases in the direction of the vertical axis arrow. The lift amount is a distance of the intake valve from the intake valve seat. The horizontal axis represents engine position, and engine position is marked to indicate a stroke that the cylinder of the engine is on.

The fourth plot from the top of FIG. 4 represents lift of a second intake valve of the cylinder versus engine position. Trace 408 represents lift of a second intake valve of the cylinder. The lift amount is zero at the level of the horizontal axis and the lift amount increases in the direction of the vertical axis arrow. The lift amount is a distance of the intake valve from the intake valve seat. The horizontal axis represents engine position, and engine position is marked to indicate a stroke that the cylinder of the engine is on. A small separation between the horizontal axis and trace 408 is shown to increase the visibility of trace 408 even though the second intake valve is fully closed when trace 408 is near the horizontal axis.

The fifth plot from the top of FIG. 4 represents a plot of cylinder state versus engine position. The cylinder is activated (e.g., receiving and combusting fuel) when trace 410 is at a higher level near the vertical axis arrow. The cylinder is deactivated (e.g., not receiving fuel and not combusting fuel) when trace 410 is at a lower level near the horizontal axis. Trace 410 represents the state of the cylinder. The horizontal axis represents engine position, and engine position is marked to indicate a stroke that the cylinder of the engine is on.

The sixth plot from the top of FIG. 4 represents lift of exhaust valves (e.g., 54 of FIG. 1) versus engine position. Trace 412 represents lift of a first and second exhaust valve of the cylinder. The lift amount is zero at the level of the horizontal axis and the lift amount increases in the direction of the vertical axis arrow. The lift amount is a distance of the exhaust valve from the exhaust valve seat. The horizontal axis represents engine position, and engine position is marked to indicate a stroke that the cylinder of the engine is on. A small separation between the horizontal axis and trace 412 is shown to increase the visibility of trace 412 even though the exhaust valves are fully closed when trace 412 is near the horizontal axis.

At the engine position of the vertical axis and prior to p10, the cylinder is deactivated and one or more cylinders are activated. The engine is rotating. The first intake valve is held partially open via a decompression valve actuator (e.g., 17 of FIG. 1). The lift of the second intake valve continues to increase as the second intake valve follows a base profile of a cam beginning shortly before engine position p10 (not shown). The exhaust valves are near a fully closed position.

At engine position p10, the cylinder is deactivated and other cylinders of the engine are activated (not shown). The central throttle is fully open and the port throttle of the cylinder is fully closed. The lift of the first intake valve of the cylinder begins to increase as the first intake valve follows a base profile of a cam beginning at engine position p10. The base profile provides a base lift amount and the base lift amount and the base profile are the base profile and lift amounts for the intake valves are for an operating cylinder (e.g., a cylinder in which fuel is being combusted).

Between engine position p10 and engine position p11, the cylinder remains deactivated and the central throttle remains fully open. The port throttle is fully closed and the lift of the first and second intake valves increases and then decreases to follow profiles of base cams. The exhaust valves remain fully closed. The cylinder may draw gases from the intake manifold into the cylinder during this engine position interval.

At engine position p11, the first intake valve ceases following its base cam profile and it remains open since the decompression valve actuator (not shown) is activated. The second intake valve is partially open and it continues to close. The cylinder remains deactivated and the central throttle remains fully open. The port throttle remains fully closed. Since the port throttle is closed, very little may be drawn from the intake manifold into the engine cylinder while the first intake valve is open so that mass flow of cool air from the intake manifold through the cylinder to the exhaust may be eliminated and/or exhaust may be drawn from the exhaust manifold through the cylinder into the intake manifold, thus eliminate exhaust cooling and/or enabling intake charge heating. The exhaust valves remain fully closed. Alternatively, the port throttle may be closed during a portion of the cylinder's expansion stroke and open during intake, compression, and exhaust strokes. Such port throttle operation may reduce flow of mass from the cylinder through the cylinder's exhaust ports. The port throttle closing timing may be based on exhaust manifold pressure and cylinder pressure.

It may be noted that opening the port throttle earlier into the expansion stroke map prevent the cylinder pressure from dropping too negative and increasing engine pumping work at the expense of increased charge mass crossing the intake valve. Opening the port throttle later may increase pumping work but may decrease flow across the engine back into the intake, which may be beneficial.

In some examples, the port throttles of a given cylinder may be held at a specified position throughout the cycle of the cylinder. The port throttles may control internal EGR flow rates. Starting during the compression stroke of a cylinder, the port throttles may reduce the mass flow across the intake valve of the cylinder, and reduce the flow rate of fresh charge into the cylinder during the expansion stroke of the cylinder compared to the unthrottled engine. Flows into the cylinder from the exhaust manifold may increase during the exhaust stroke of the cylinder compared to the unthrottled case, depending on the degree of pressure drop in the cylinder during the power stroke of the cylinder. The pressure drop may be in part a function of throttled volume on the intake runner side. The flow out of the cylinder across the intake valve during exhaust may also be reduced. Fresh charge flowing into the cylinder during intake may also diminish with the throttling of both ports.

Between engine position p11 and engine position p12, the engine rotates and the cylinder moves from its compression stroke to its expansion stroke. The first intake valve remains open and the second intake valve fully closes. The first intake valve remains open via activating a cylinder decompression actuator (not shown). The exhaust valves remain fully closed and the cylinder remains deactivated. The port throttle remains fully closed and the central throttle is fully open.

At engine position p12, the exhaust valves begin to open and the port throttle is fully opened. By opening the port throttle, exhaust may be drawn from the exhaust manifold, through the exhaust ports, through the intake ports, and into the engine intake manifold since the exhaust valves of the cylinder are open and since the first intake valve of the cylinder is partially open and because of low pressure in the cylinder that may be due to port throttling. The exhaust flows to the intake manifold because exhaust pressure is greater than intake manifold pressure (not shown). The central throttle is fully open and the first intake valve is open. The second intake valve is fully closed.

Between engine position p12 and engine position p13, the central throttle remains fully open and the cylinder remains deactivated. The port throttle is fully open and the first intake valve is partially open. The second intake valve is fully closed and the exhaust valves are open.

At engine position p13, the central throttle is fully open and the port throttle is fully closed. The first intake valve is partially open and the second intake valve is fully closed. The exhaust valves are nearly fully closed. By closing the port throttle, air may be prevented from entering the cylinder via the intake manifold and exhaust may be drawn from the exhaust manifold through the cylinder into the intake manifold, thus eliminating exhaust cooling and/or enabling intake charge heating. The second intake valve begins to open shortly after engine position p13.

In this way, port throttles may be operated in conjunction with a valve decompression actuator to reduce engine pumping losses and increase exhaust gas temperatures. In addition, air flow though the engine may be reduced so that the temperature of exhaust gases may reach higher levels.

Referring now to FIGS. 5 and 6, a method for operating an engine is shown. In particular, a flowchart of a method for operating an internal combustion engine is shown. The method of FIGS. 5 and 6 may be stored as executable instructions in non-transitory memory in systems such as shown in FIGS. 1-2B. The method of FIGS. 5 and 6 may be incorporated into and may cooperate with the systems of FIGS. 1-2B. Further, at least portions of the method of FIGS. 5 and 6 may be incorporated as executable instructions stored in non-transitory memory while other portions of the method may be performed via a controller transforming operating states of devices and actuators in the physical world. The controller may employ engine actuators of the engine system to adjust engine operation, according to the method described below. Further, method 500 may determine selected control parameters from sensor input.

At 502, method 500 determines vehicle operating conditions. Vehicle operating conditions may include but are not limited to engine temperature, accelerator pedal position, catalyst temperature, ambient temperature, ambient pressure, driver demand torque, engine speed, and engine load. Vehicle operating conditions may be determined via vehicle sensors and the engine controller described in FIG. 1. Method 500 proceeds to 504.

At 504, method 500 judges if the temperature of the catalyst or after treatment device is greater than a threshold temperature (e.g., a catalyst light off temperature). The catalyst light off temperature may be an empirically determined temperature that may be determined via monitoring catalyst efficiency and catalyst temperature. If method 500 judges that the after treatment device temperature is greater than the threshold temperature, the answer is yes and method 500 proceeds to 560. Otherwise, the answer is no and method 500 proceeds to 506. At 560, method 500 operates the engine with base intake and exhaust valve lift amounts. In one example, the intake and exhaust valves follow lifts of cam lobes of a camshaft. The intake valve open during intake strokes of cylinders and the exhaust valves open during exhaust strokes of engine cylinders. In addition, the intake valve decompression actuators are deactivated so that the intake valves follow base cam profiles. The fourth plot from the top of FIG. 4 shows one example of intake valve lift when operating an intake valve via a base cam profile. The sixth plot from the top of FIG. 4 shows one example of exhaust valve lift when operating an exhaust valve via a base cam profile. The Method 500 proceeds to exit.

Additionally, during the course of engine operation when the catalyst is at the threshold temperature, at least a portion of engine cylinders may be deactivated during conditions of low driver demand torque. The decompression actuators for the deactivated cylinders may be activated so that the intake valves of deactivated cylinders remain open for the engine's entire cycle (e.g. two revolutions or four strokes for a four stroke engine).

At 506, method 500 determines engine load. Engine load may be determined via measuring fuel flow to the engine and the total number of activated cylinders. Method 500 proceeds to 508.

At 508, method 500 judges whether or not the engine is presently in an operating range (e.g., engine speed and engine load range) where cylinder deactivation is permitted or allowed at the present engine speed and engine load. In one example, a map stored in controller memory may identify specific engine speeds and engine loads where cylinder deactivation is permitted. The speed and load ranges may be empirically determined via operating the engine on a dynamometer and selectively deactivating cylinders. If the engine may meet the requested driver demand torque and noise/vibration/harshness requirements at a particular engine speed and engine load, cylinder deactivation may be permitted. If method 500 judges that the engine is operating in a range where cylinder deactivation is permitted, the answer is yes and method 500 proceeds to 510. Otherwise, the answer is no and method 500 proceeds to 561.

At 561, method 500 adjusts fuel injection timing and fuel injection amount to increase exhaust gas temperatures so that a temperature of the exhaust gas after treatment device may be increased. In one example, method 500 retards fuel injection timing and increases an amount of fuel injected to the engine cylinders. In addition, the engine's central throttle may be at least partially closed and a total number of post combustion fuel injections may be increased. Method 500 returns to 504.

At 510, method 500 deactivates selected engine cylinders. In one example, the cylinders that are to be deactivated may be stored in a table or function in controller memory that may be indexed or referenced by engine speed and driver demand torque. The cylinder within the table or function may be based on noise/vibration/harshness and capacity to meet driver demand torque. In one example, method 500 may deactivate all cylinders of one cylinder bank and operate all cylinders of a different cylinder bank. Alternatively, method 500 may deactivate cylinders of two cylinder banks and operate other cylinder in the two cylinder banks. Thus, method 500 may deactivate a first group of engine cylinders while a second group of engine cylinders remains activated. Method 500 selects the cylinders that are to be deactivated and ceases delivering fuel to the selected cylinders. The intake and exhaust poppet valves of the deactivated cylinders may continue to open and close. At least one engine cylinder remains activated and it provides torque to keep the engine rotating and meet driver demand torque. Method 500 proceeds to 512.

At 512, method 500 adjusts fuel amounts that are delivered to active cylinders. In one example, method 500 increases the amount of fuel injected to the active cylinders so that the engine may produce the requested driver demand torque via fewer active cylinders. The air charge entering the active cylinders may also increase. The intake and exhaust valves of the deactivated cylinders continue to open and close during each engine cycle. Method 500 proceeds to 514.

At 514, method 500 activates the decompression valve actuators to hold at least one intake valve of each deactivated cylinder partially open (e.g., less than a full lift amount produced by the engine's base cam). The decompression valve actuators may be of the type described in U.S. Pat. No. 9,410,455, which is hereby fully incorporated by reference for all purposes. The intake valves are held open at least a threshold amount of lift for an entire cycle of the engine. The decompression valve actuators may provide negative lash which acts to hold intake valves open during an entire engine cycle as shown in FIG. 4. For intake valve held open via decompression valve actuators, the lift of the intake valves may be increased greater than the threshold lift amount to follow an intake poppet valve lift amount generated from a base cam lift profile during an intake stroke of the cycle (e.g., as shown in FIGS. 3 and 4).

Additionally, in some examples, method 500 may operate port throttles of deactivated cylinders as shown in FIG. 4. In particular, the port throttles may be held fully closed during intake and compression strokes of deactivated cylinders so that air flow into the cylinders may be reduced, thereby reducing air flow through the cylinders so that exhaust gas temperatures may be increased to higher levels. The port throttles may be partially or fully opened during exhaust strokes of the deactivated cylinders to facilitate EGR flow to the activated cylinders, thereby reducing NOx and fuel consumption. Further, method 500 may fully close vanes of the turbocharger turbine to increase exhaust back pressure to improve EGR flow internally through the engine. In one example, the average mass flow from the intake manifold to the exhaust manifold through the deactivated cylinder may be zero or negative (e.g., flow toward from the exhaust manifold to the intake manifold).

In still other examples, a position of a central throttle may be adjusted to adjust exhaust gas recirculation through deactivated engine cylinders. Method 500 proceeds to 516.

At 516, method 500 judges if a steady state temperature of the catalyst or after treatment device is greater than the threshold temperature (e.g., a catalyst light off temperature). The steady state catalyst light off temperature may be an empirically determined temperature that may be determined via monitoring catalyst efficiency and catalyst temperature for a predetermined amount of time and averaging the after treatment device temperature. If method 500 judges that the steady state after treatment device temperature is greater than the threshold temperature, the answer is yes and method 500 proceeds to 540. Otherwise, the answer is no and method 500 proceeds to 518.

At 518, method 500 judges if NOx output of the engine is greater than a threshold amount of NOx. Method 500 may monitor NOx in the engine's exhaust system to determine the amount of NOx that is output via the engine. If method 500 judges that NOx output of the engine is greater than the threshold amount of NOx, the answer is yes and method 500 proceeds to 520. Otherwise, the answer is no and method 500 proceeds to 526.

At 520, method 500 judges if the engine's present air-fuel ratio (Af) is less than a threshold desired air-fuel ratio (Af_des). If method 500 judges that the engine's air-fuel ratio is less than the desired air-fuel ratio, the answer is yes and method 500 proceeds to 528. Otherwise, the answer is no and method 500 proceeds to 522.

At 526, method 500 judges if the engine's present air-fuel ratio (Af) is less than a threshold desired air-fuel ratio (Af_des). Method 500 may monitor the engine's air-fuel ratio via an oxygen sensor in the engine's exhaust system. If method 500 judges that the engine's air-fuel ratio is less than the desired air-fuel ratio, the answer is yes and method 500 proceeds to 528. Otherwise, the answer is no and method 500 proceeds to 530.

At 530, method 500 adjusts the engine's central throttle to achieve a desired after treatment temperature (Tdoc_des). In one example, method 500 may partially close the central throttle to increase exhaust temperatures so as to supply additional heat to the after treatment device. In addition, the central throttle position may be adjusted such that a net negative flow through deactivated cylinders occurs. For example, the central throttle may be closed until exhaust begins to flow through deactivated cylinders and into the engine intake manifold. Method 500 adjusts the position of the central throttle and returns to 504.

At 528, method 500 adjusts the engine's central throttle to achieve a desired engine air-fuel ratio. In particular, the central throttle opening amount may be increased or decreased to change the amount of air that flows through the engine while the amount of fuel that is injected is based on the driver demand torque. The desired engine air-fuel ratio may be a function of engine temperature, engine speed, and driver demand torque. Thus, if the present engine air-fuel ratio is leaner than may be desired, the central throttle may be partially closed. If the present engine air-fuel ratio is richer than may be desired, the central throttle may be partially opened. Method 500 returns to 504.

At 522, method 500 adjusts the engine's central throttle to achieve a desired engine NOx output. In one example, the central throttle opening amount may be increased or decreased to change the amount of engine NOx produced. Opening or closing the central throttle may increase or decrease the amount of EGR that is provided to activated cylinders so that engine NOx may be reduced or increased to match a desired engine NOx output level. In one example, method 500 may adjust the throttle position in response to output of a NOx sensor to achieve the desired engine NOx output. The position of the central throttle is adjusted to control exhaust flow through one or more deactivated cylinders from the exhaust manifold into the engine intake manifold. Thus, the net flow though the one or more deactivated cylinders may be adjusted to zero or negative (e.g., from the exhaust manifold to the intake manifold). Method 500 returns to 504.

At 540, method 500 judges if NOx output of the engine is greater than a threshold amount of NOx. Method 500 may monitor NOx in the engine's exhaust system to determine the amount of NOx that is output via the engine. If method 500 judges that NOx output of the engine is greater than the threshold amount of NOx, the answer is yes and method 500 proceeds to 542. Otherwise, the answer is no and method 500 proceeds to 546.

At 542, method 500 judges if the engine's present air-fuel ratio (Af) is less than a threshold desired air-fuel ratio (Af_des). Method 500 may monitor the engine's air-fuel ratio via an oxygen sensor in the engine's exhaust system. If method 500 judges that the engine's air-fuel ratio is less than the desired air-fuel ratio, the answer is yes and method 500 proceeds to 548. Otherwise, the answer is no and method 500 proceeds to 544.

At 546, method 500 judges if the engine's present air-fuel ratio (Af) is less than a threshold desired air-fuel ratio (Af_des). Method 500 may monitor the engine's air-fuel ratio via an oxygen sensor in the engine's exhaust system. If method 500 judges that the engine's air-fuel ratio is less than the desired air-fuel ratio, the answer is yes and method 500 proceeds to 548. Otherwise, the answer is no and method 500 proceeds to 550.

At 550, method 500 adjusts the engine's central throttle to a fully open position so that engine pumping losses may be reduced, thereby decreasing engine fuel consumption. Method 500 adjusts the position of the central throttle and returns to 504.

At 548, method 500 adjusts the engine's central throttle to achieve a desired engine air-fuel ratio. In particular, the central throttle opening amount may be increased or decreased to change the amount of air that flows through the engine while the amount of fuel that is injected is based on the driver demand torque. The desired engine air-fuel ratio may be a function of engine temperature, engine speed, and driver demand torque. Thus, if the present engine air-fuel ratio is leaner than may be desired, the central throttle may be partially closed. If the present engine air-fuel ratio is richer than may be desired, the central throttle may be partially opened. Method 500 returns to 504.

At 544, method 500 adjusts the engine's central throttle to achieve a desired engine NOx output. In one example, the central throttle opening amount may be increased or decreased to change the amount of engine NOx produced. Opening or closing the central throttle may increase or decrease the amount of EGR that is provided to activated cylinders so that engine NOx may be reduced or increased to match a desired engine NOx output level. In one example, method 500 may adjust the throttle position in response to output of a NOx sensor to achieve the desired engine NOx output. Method 500 returns to 504.

In this way, it may be possible to increase a temperature of an exhaust gas after treatment device while using less fuel. In addition, port throttles may be utilized to further advantage to reduce engine pumping work.

Thus, the method of FIGS. 5 and 6 provides for an engine operating method, comprising: deactivating a cylinder and holding an intake poppet valve of the cylinder open for an entire duration of a cycle of an engine that includes the cylinder; and operating an exhaust valve of the cylinder during the cycle. The engine method includes where holding the intake poppet valve of the cylinder open for the entire duration of the cycle of the engine includes holding the intake poppet valve open a threshold lift amount. The engine method further comprises increasing lift of the intake poppet valve above the threshold lift amount to follow an intake poppet valve lift amount generated from a base cam lift profile during an intake stroke of the cycle. The engine method includes where the cylinder is deactivated in response to a request to heat an after treatment device, and where the intake poppet valve is open less than a squish height of a cylinder plus a valve recess plus a depth of a piston valve pocket.

In some examples, the engine method further comprises at least partially closing a central throttle of the engine in response to the request to heat the after treatment device. The engine method includes where the central throttle is closed to a position where net flow across the intake poppet valve is negative and from the cylinder to an intake manifold during the cycle of the engine. The engine method includes where deactivating the cylinder includes ceasing fuel flow to the cylinder, and further comprising: adjusting a port throttle to a partially open position for the entire duration of the cycle of the engine. The engine method further comprises combusting fuel in one or more cylinders during the cycle of the cylinder.

The method of FIGS. 5 and 6 also provides for an engine operating method, comprising: opening a central throttle of an engine and holding closed a port throttle of a cylinder of the engine during at least a portion of an expansion stroke of the cylinder in response to a request to heat an engine exhaust gas after treatment system, the intake stroke of the cylinder occurring during a cycle of the engine; and holding open the port throttle during at least part of an exhaust stroke of the cylinder, the exhaust stroke of the cylinder occurring during the cycle of the engine. The engine method further comprises deactivating the cylinder in response to the request to heat the engine exhaust gas after treatment system. The engine method further comprises increasing fuel injected to a second cylinder in response to the request to heat the engine exhaust. The engine further comprises at least partially closing vanes of a turbocharger turbine in response to the request to heat the engine exhaust gas after treatment system. The engine method further comprises holding open an intake valve of the cylinder and adjusting lift of the intake valve to follow at least a portion of a trajectory of base valve lift during the entire cycle of the engine. The engine method further comprises opening and closing an exhaust valve of the cylinder during the cycle of the engine.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. Further, portions of the methods may be physical actions taken in the real world to change a state of a device. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller. One or more of the method steps described herein may be omitted if desired.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine operating method, comprising:

deactivating a cylinder via ceasing fuel flow thereto and holding an intake poppet valve of the cylinder open for an entire duration of a cycle of an engine that includes the cylinder;

operating an exhaust valve of the cylinder during the cycle; and adjusting a port throttle to a partially open position for the entire duration of the cycle of the engine.

2. The engine method of claim 1, where holding the intake poppet valve of the cylinder open for the entire duration of the cycle of the engine includes holding the intake poppet valve open a threshold lift amount.

3. The engine method of claim 2, further comprising increasing lift of the intake poppet valve above the threshold lift amount to follow an intake poppet valve lift amount generated from a base cam lift profile during an intake stroke of the cycle.

4. The engine method of claim 1, where the cylinder is deactivated in response to a request to heat an after treatment device, and where the intake poppet valve is open less than a squish height of the cylinder plus a valve recess plus a depth of a piston valve pocket.

5. The engine method of claim 4, further comprising at least partially closing a central throttle of the engine in response to the request to heat the after treatment device.

6. The engine method of claim 5, where the central throttle is closed to a position where net flow across the intake poppet valve is negative and from the cylinder to an intake manifold during the cycle of the engine.

7. The engine method of claim 1, further comprising combusting fuel in one or more cylinders during the cycle of the cylinder.

8. An engine system, comprising:

a diesel engine including a cylinder included in a first group of cylinders, a second group of cylinders, a central throttle, and an exhaust after treatment device, the cylinder including at an intake poppet valve and a decompression actuator to lift the intake poppet valve;

a controller including executable instructions stored in non-transitory memory that cause the controller to deactivate the cylinder and other cylinders included in the first group of cylinders while operating cylinders in the second group of cylinders in response to a request to heat the exhaust after treatment device, and additional instructions to hold the intake poppet valve open during an entire cycle of the diesel engine in response to the request to heat the exhaust gas after treatment device.

9. The engine system of claim 8, further comprising:

a central throttle, a port throttle for the cylinder, and a port throttle for each of the other cylinders included in the first group of cylinders.

10. The engine system of claim 9, further comprising additional instructions that cause the controller to open the port throttle for the cylinder during at least a portion of an exhaust stroke of the cylinder and to close the port throttle during at least a portion of an expansion stroke.

11. The engine system of claim 10, further comprising additional instructions that cause the controller to fully open the central throttle while the request to heat the engine exhaust after treatment system is asserted.

12. The engine system of claim 8, where the intake poppet valve is held open via the decompression actuator.

13. The engine system of claim 8, further comprising additional instructions increase fuel flow to cylinders in the second group of cylinders in response to the request to heat the engine after treatment system.

14. An engine operating method, comprising:

opening a central throttle of an engine and holding closed a port throttle of a cylinder of the engine during at least a portion of an expansion stroke of the cylinder in response to a request to heat an engine exhaust gas after treatment system, an intake stroke of the cylinder occurring during a cycle of the engine; and holding open the port throttle during at least part of an exhaust stroke of the cylinder, the exhaust stroke of the cylinder occurring during the cycle of the engine.

15. The engine method of claim 14, further comprising deactivating the cylinder in response to the request to heat the engine exhaust gas after treatment system.

16. The engine method of claim 14, further comprising increasing fuel injected to a second cylinder in response to the request to heat the engine exhaust.

17. The engine method of claim 14, further comprising at least partially closing vanes of a turbocharger turbine in response to the request to heat the engine exhaust gas after treatment system.

18. The engine method of claim 14, further comprising holding open an intake valve of the cylinder and adjusting lift of the intake valve to follow at least a portion of a trajectory of base valve lift during the entire cycle of the engine.

19. The engine method of claim 18, further comprising opening and closing an exhaust valve of the cylinder during the cycle of the engine.

* * * * *